US006082565A

United States Patent [19]

Harrold

[11] Patent Number: 6,082,565

[45] Date of Patent: Jul. 4, 2000

[54] CHILD RESISTANT CAP WITH ONE-WAY RATCHET AND LOCKING CHANNEL

[75] Inventor: John E. Harrold, Bloomsbury, N.J.

[73] Assignee: Valley Design Inc., Bloomsbury, N.J.

[21] Appl. No.: 09/384,011

[22] Filed: Aug. 26, 1999

[51] Int. Cl.[7] ..... B65D 55/02

[52] U.S. Cl. ..... 215/218; 215/220; 215/222

[58] Field of Search ..... 215/218, 219, 215/220, 221, 222, 223

[56] References Cited

U.S. PATENT DOCUMENTS

| | | | |
|---|---|---|---|
| 2,597,307 | 5/1952 | Elkind . | |
| 3,426,931 | 2/1969 | Jensen | 215/218 |
| 3,612,324 | 10/1971 | Malick | 215/222 |
| 3,656,646 | 4/1972 | Taylor | 215/218 |
| 3,679,085 | 7/1972 | Gach . | |
| 3,739,933 | 6/1973 | Degaetano | 215/222 |
| 3,822,805 | 7/1974 | Marchant . | |
| 3,857,507 | 12/1974 | Lecinski, Jr. | 215/218 |
| 3,870,182 | 3/1975 | Georgi | 215/220 |
| 3,895,731 | 7/1975 | Coursaut | 215/218 |
| 3,896,335 | 7/1975 | Bogert | 215/219 |
| 3,927,783 | 12/1975 | Bogert | 215/222 |
| 4,006,836 | 2/1977 | Micallef | 215/218 |
| 4,641,759 | 2/1987 | Kelley | 215/220 |
| 5,148,931 | 9/1992 | Minh | 215/220 |
| 5,217,130 | 6/1993 | Weinstein | 215/220 |
| 5,228,583 | 7/1993 | Weinstein | 215/220 |
| 5,433,329 | 7/1995 | Weinstein | 215/220 |
| 5,865,330 | 2/1999 | Buono | 215/216 |

*Primary Examiner*—Stephen K. Cronin
*Attorney, Agent, or Firm*—Kenneth P. Glynn, Esq.

[57] ABSTRACT

The present invention is a child resistant cap and dispenser. It includes a dispensing container, a flange located non-rotatably connected on the container neck with one-way ratchets, located thereon, said flange being non-rotatably connected to said container neck; a ring collar, non-removably and rotatably connected to the container neck with one-way ratchets located thereon, in functional and cooperative contact with the flange ratchets to permit rotation of it about the neck in one direction and so as to prevent rotation in the opposite direction. The ring collar has an outer circular wall, with one of (i) at least one keyway track and, (ii) at least one keyway protrusion, located thereon, the other being located on a cap, adapted to fit onto the said ring collar. There is a spring mechanism located on at least one of the necks, the collar and the cap, to bias the cap upwardly away from the dispensing container when the cap is connected to the ring collar.

24 Claims, 2 Drawing Sheets

CHILD RESISTANT CAP WITH ONE-WAY RATCHET AND LOCKING CHANNEL

BACKGROUND OF THE INVENTION

1. Field of the Invention

The present invention relates to child resistant safety caps and containers which require complex multiple step movement for operation.

2. Information Disclosure Statement

The following is representative of prior art patents relating to child resistant safety caps:

U.S. Pat. No. 2,597,307 to Bertram Elkind, describes a closure comprising, in combination, an internal cap having internal threads adapted to engage the threads of a container neck, an external cap coaxially circumjacent said internal cap and rotatable therearound; a circumferential pin-and-groove connection between said caps consisting of an annular groove in one cap and an engaging pin secured in the other cap; said one cap also having a plurality of grooves communicating with said annular groove, spaced around said annular groove, and slanted toward the top of the closure at an angle of less than 10°, one of said slanted grooves having an offset portion at its end into which said pin may be moved to provide interlocking between said caps; a first index on said internal cap; and a second index on the exterior of said external cap corresponding in shape to said one of said slanted grooves, registration of said indexes indicating that said pin is opposite said one slanted groove.

U.S. Pat. No. 3,679,085 to Peter P. Gach, describes a child-proof cap for medicine bottles or the like having an inner threaded closure member and an outer overcap or driver. The closure and driver have co-operating one-way driving means for screwing the closure onto the bottle which are engaged by pushing the driver down, and second co-operating driving means for unscrewing the closure which are engaged by pulling the driver upwardly and squeezing its walls inwardly.

U.S. Pat. No. 3,822,805 to Paul A. Marchant, describes a safety closure for containers having a threaded neck, which closure includes an inner closure adapted to be threadably received on the container neck and an outer or overclosure covering, and normally freely rotatable on, the inner closure. The inner closure is provided with continuous engaging means around the lower portion of its skirt, which means are engageable by means provided on two downwardly projecting flexible tabs provided in the lower portion of the skirt of the overclosure. Application of pressure between the thumb and finger compresses the tabs of the outer closure to engage the inner closure, thereby permitting rotation of the locked inner and outer closures to remove the safety closure from the neck of the container. A second embodiment includes a plurality of integrally formed projections on both the top surface of the inner closure and on the bottom surface of the outer closure. The projections are adapted to engage to rotate the inner closure when the outer closure is rotated to attach the safety closure to the container and to disengage when the outer closure is rotated to detach the safety closure without pressing the tabs to lock the outer closure into engagement with the inner closure.

U.S. Pat. No. 3,870,182 to Walter L. Georgi, describes a safety closure for a container having an externally threaded neck. The closure includes an inner member that is internally threaded for application to the neck of the container, and an outer closure member fitted over the inner member and holding the inner member captive therein. The outer member fits loosely over the inner member so that the outer member is normally free for rotation relative to the inner member and is also free for limited telescopic movement over the inner member. Lugs are provided on the inner surface of the outer member, and recesses are formed in the outer surface of the inner member, so that when the outer member is lifted, pressed radially inwardly, and rotated the lugs mesh with the recesses to provide engagement between the inner and outer members so that the inner member can be removed from the container by continued rotation of the outer member. Thus, simultaneous application of lifting, radially inwardly compressive, and rotational forces to the outer member is required in order to remove the closure from the container.

U.S. Pat. No. 3,896,335 to Clayton Bogert, describes the present invention provides a protective safety closure for containers. The safety closure comprises an inner and outer cap made of pliable material such as plastics, or the like. The inner cap has an internal threaded portion which can fit over the neck of any conventional container. At the base, the inner cap has an outwardly extending ledge. Below the ledge are a series of serrations or notches. The outer cap has an inwardly extending ledge provided on its inner perimeter with a series of serrations or notches. After the inner cap has been threaded on to the container, the outer cap is snapped thereover so that its ledge engages under the ledge protruding from the base of the inner cap. However, the serrations on the inner and outer cap do not meet and the outer cap may be freely rotated without in any way rotating the inner cap. Thus, a safety closure which may not be inadvertently opened, is accomplished. When it is desired to open the closure a slight flexing pressure applied to the base of the outer cap will cause the serrations or notches on both caps to inter-engage or mesh, whereupon the rotary movement of the outer cap will be transmitted to the inner cap and the inner cap may be thus removed.

U.S. Pat. No. 4,641,759 to John Kelley, describes a twist-type closure for bottles. The closure includes an inner member with a disk-like portion and a depending peripheral lip, which is adapted on the interior to match the particular closure provision of the bottle. Projecting upward from the disk portion is a neck terminating in a closed flange having, in one embodiment, a slightly greater diameter than the neck. An outer member generally surrounds, and is rotatable with respect to, the inner member. This outer member also has a disk-like portion and a depending peripheral lip. The outer member has a central opening to permit receiving the flange therethrough to assemble the closure. Between the disk portions of the inner and outer members is a biasing member to normally maintain these portions separated but allow movement toward each other when pressure is applied to the outer member. Also, between the inner and outer members are cooperating opening tabs which, when aligned and moved into engagement by pressure upon the outer member, permit the outer and inner members to be turned counter-clockwise in unison to effect the removal of the closure. Arrow indicia on the top surfaces of the outer and inner members indicate the proper alignment of the opening tabs. Cooperating closure tab means carried by the members effect the clock-wise turning of the components in unison to effect tightening of the closure. Optionally, numerals are equally spaced around the opening in the outer member to indicate the time of the next dosage of a medicine, for example.

U.S. Pat. No. 5,148,931 to Do Le Minh, describes this invention provides a new and simple tamper-resistant, safety closure for a container having threaded neck. It requires the user to align the two arrows, then give it an upward lift while turning in the counterclockwise direction to unscrew it from the container. Features of the invention useful in accomplishing the above objects include an outer cap and an inner cap. The interior surface of the outer cap has a plurality of identical protrusions, call the type A protrusions, and one type B protrusion. The exterior surface of the inner cap has a plurality of identical grooves, called the type A grooves, and one type B groove. If the type B protrusion is lifted into the type B groove, then the two caps inter-lock and turning the outer cap in the counter-clockwise direction would also turn the inner cap in the same direction, resulting in the unscrewing of the closure from the container. On the other hand, if the type B protrusion is lifted into one of the type A grooves, then the outer cap will rotate without unscrewing the inner cap from the container.

U.S. Pat. No. 5,217,130 to Jack Weinstein, describes the present invention involves a child resistant closure for containers with threaded necks. It involves a cylindrical inner and outer cap with engage with one another by ratchets to close the closure. These ratchets do not engage when an attempt is made to open the closure. The inner cap has threads on its inside and is adapted to non-removably receive the outer cap in that the outer cap is rotatably engaged therewith. The outer cap is non-removably but rotatably mounted on and engaged with the inner cap. At least two biased keyway slots are used and each may be located either on the outside of the inner cap or the inside of the outer cap. There are at least two biased keyway protrusions, one corresponding to each slot, and each protrusion extends toward its corresponding keyway slot. Each is located on which ever of the inner cap and outer cap does not contain the corresponding slot. There are indexes on each of the caps and when the they are aligned, the keyway protrusions and their corresponding keyway slots will be aligned. The user will align the indexes or indicia and then lift up so that the protrusions fit into their keyway slots. In this manner, the outer cap engages the inner cap so that they are simultaneously rotated for opening. Upon closure, the protrusion will be pushed or dropped out of the slot and the ratchets will engage for proper closure.

U.S. Pat. No. 5,228,583 to Jack Weinstein, describes the present invention involves a child resistant closure for containers with threaded necks. It involves an inner cap and an outer cap which engages with one another by ratchets in order to close but these ratchets do not engage when an attempt is made to open the closure. The inner cap and the outer cap are generally cylindrical and have sides and a top, although the outer cap may have an open top. The inner cap has threads on its inside and is adapted to non-removably receive the outer cap so that the outer cap is rotatably engaged therewith. The outer cap is non-removably but rotatably mounted on an engaged with the inner cap. At least one keyway slot is located either on the outside of the inner cap or the inside of the outer cap and there is at least one keyway protrusion extending toward the keyway slot and located on which ever of the inner cap and the outer cap does not contain the slot. There are indexes on each of the caps and when they are aligned, the keyway protrusion and the keyway slot will be aligned. The user will align the indexes or indicia and then lift up so that the protrusion fits into the keyway slot. In this manner, the outer cap engages the inner cap so that they are simultaneously rotated for opening. Upon closure, the protrusion will be pushed or dropped out of the slot and the ratchets will engage for proper closure.

U.S. Pat. No. 5,433,329 to Jack Weinstein, describes a child-resistant cap with independent open and close ratchet sets. It includes an inner cap having a top and side walls and having inside surfaces and outside surfaces and an open bottom, and structure for attachment to a container. It also has a flanged base extending outwardly from its side walls with the flanged base having one-way ratchet members thereon for engagement with an outer collar for locked rotation of an outer collar with the inner cap in a circular, first direction. It also has ratchets located on the outside surface of the top for engagement with an outer cap for rotation of an outer cap with the inner cap in a circular, second direction opposite from said first direction. There is an outer cap having a top and side walls and an open bottom and having inner surfaces and outer surfaces. It is rotatably attached to the inner cap and has ratchets on its inside surface of its top for engagement with the inner cap. There is also an outer collar rotatably mounted about the inner cap and the outer cap which has ratchets thereon for engagement with the ratchets located on the base flange of the inner cap.

U.S. Pat. No. 5,865,330 to Caetano Buono, describes a child-resistant cap and container including an inner and an outer skirt depending downwardly from the top wall of the cap. The inner skirt has an internally threaded surface for engagement with the externally threaded neck of the container. The outer skirt has a pair of longitudinal slots defined in the bottom portion of the outer skirt for forming a flexible tab therebetween. A tooth is radially spaced from the container neck for edgewise engagement with the tab when the cap is in its locked position. The locked cap can be removed from the container only by depressing the tab inwardly to clear the tooth as the cap is rotated in a retrograde or opening direction.

Notwithstanding the prior art, the present invention is neither taught nor rendered obvious thereby.

SUMMARY OF THE INVENTION

The present invention is a child resistant cap and dispenser. It includes a dispensing container, a flange located non-rotatably connected on the container neck with one-way ratchets, located thereon, said flange being non-rotatably connected to said container neck; a ring collar, non-removably and rotatably connected to the container neck with one-way ratchets located thereon, in cooperation with the flange ratchets to permit rotation of it about the neck in one direction and so as to prevent rotation in the opposite direction. The ring collar has an outer circular wall, with one of (i) at least one keyway track and, (ii) at least one keyway protrusion, located thereon, the other being located on a cap, adapted to fit onto the ring collar. There is a spring mechanism located on at least one of the necks, the collar and the cap, to bias the cap upwardly away from the dispensing container when the cap is connected to the ring collar.

When the cap is placed onto the ring collar and rotated thereon in a downwardly rotating fashion, and the keyway track and the keyway protrusion engage to a locking position, the cap and ring collar may not be rotated in one direction due to ratchet stop interaction and the cap and ring collar may be rotated in an opposite direction while the keyway track and the keyway protrusion remain engaged in the locking position. Further, when the ring collar is held stationary and the cap is pressed downward and rotated in an unlocking keyway position, the cap may be removed from the ring collar.

In one embodiment, the child resistant cap and dispenser keyway track has a shape with a U-turn contained therein. In most preferred embodiments the U-turn is the base of a J and the keyway track has a sloped J configuration. The dispenser container may be a squeeze bottle and the neck may be a narrowing neck with a fine dispensing orifice at its top, e.g. for fine mist spraying. In these embodiments, the cap may include a sealing pixel which extends to seal the orifice when the cap is connected to the ring collar in a locking position. In preferred embodiments, there are a plurality of keyway tracks and a plurality of keyway protrusions. Further, the spring biasing mechanism is a spring located in an inside area of the cap.

In some embodiments, at least one keyway track is located on the outside of the ring collar, and there is at least one keyway protrusion is located on the inside of the cap.

In other embodiments, at least one keyway track is located on the inside of the cap and there is at least one keyway protrusion located on the outside of the ring collar outer wall.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
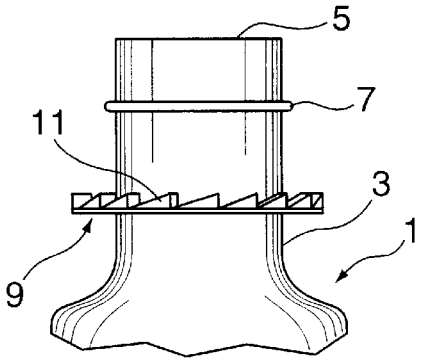
FIG. 1 shows a partial side view of a present invention container and ratchet flange.
Figure 2:
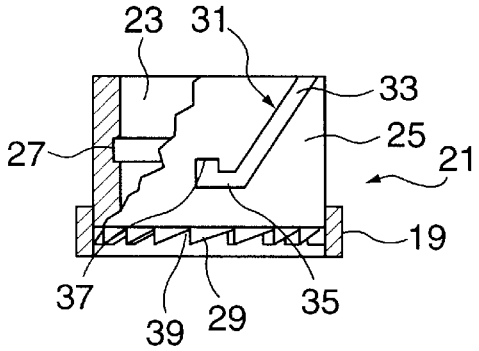
FIG. 2 shows a partial cut side view of one embodiment of a ring collar used in the present invention.

FIG. 1 illustrates a partial side cut view of two components of one embodiment of the present invention child resistant cap and dispenser. Container 1 is shown with neck 3 and open dispensing top 5. Rib 7 is used to rotatably secure a ring collar such as is shown in FIG. 2, discussed below. There is a flange located about container neck 3, and it includes ratchets, such as ratchet tooth 11. This permits counterclockwise rotation, but prevents clockwise rotation. (Everything described throughout the figures herein are based on clockwise cap closure and counterclockwise cap opening, but these could be reversed without exceeding the boundaries of the present invention.)

FIG. 2 shows a side, partially cut view of ring collar 21. It includes sidewall 25, open bottom 39 and open top 23. It is adapted to fit over neck 3 shown in FIG. 1 and may be force fitted over rib 7 for secure fastening thereto (not being able to be removed therefrom), but rotatably free and able to be moved slightly up and down due to slot 27 located on the inside of wall 25 of ring collar 21. One-way ratchet such as ratchet tooth 29 located at the bottom of ring collar 21 engages with the one-way ratchets such as ratchet tooth 11 of flange 9 of FIG. 1 to prevent clockwise rotation and to permit counterclockwise rotation of ring collar 21. Wall 19, at the bottom of ring collar 21, conceals the ratchets and provides holding areas.

Ring collar 21 also includes keyway track 31 for receiving a protrusion on the inside of a cap such as described in conjunction with the cap described in FIG. 4 below.

Keyway trap 31 has a sloped first leg 33, a horizontal second leg 35 and a vertical third leg 37, thus establishing a sloped "J" configuration.

Figure 3:
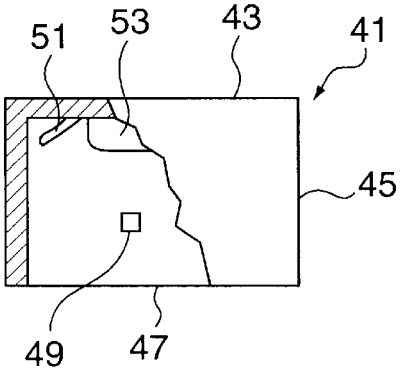
FIG. 3 shows a partial cut side view of a cap of the present invention which may be used in conjunction with the components of the present invention shown in FIGS. 1 and 2.

FIG. 3 shows a cap 41 which is used in conjunction with the previously described components shown in FIGS. 1 and 2. It includes a sidewall 45, a top 43 and an open bottom 47. When ring collar 21 of FIG. 2 is secured to container 1 of FIG. 1, cap 41 may be placed onto collar 21 and rotated until keyway protrusion 49 engages keyway track 31 of FIG. 2. Downward clockwise rotation (normal cap screwing movement) will cause keyway protrusion 49 to slide down slope 33 and to the left most position of leg 35 where it will stop. The ratchets will prevent further rotation of the cap and will have maintained ring collar 21 in a fixed position. When a user then releases cap 41, spring 51 will push cap 41 up slightly so that key way protrusion 49 will lock into the upper most position of vertical leg 37. Seal 53 will close opening 5 of container 1.

To open the present invention configuration resulting from the components described above with respect to FIGS. 1, 2 and 3, a user would hold wall 19, press cap 41 downwardly and then rotate cap 41 counterclockwise. This complex movement creates double child lock protection, attempts to rotate will simply cause slippage and even if wall 19 is held to secure ring collar 21, protrusion 49 being locked in keyway 31 adds the second child resistant feature.

Figure 4:
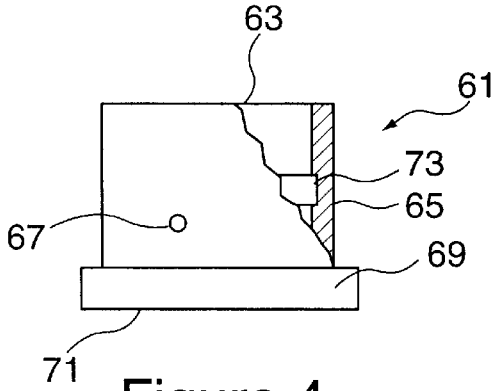
FIGS. 4 and 5 show partially cut side views of an alternate embodiment present invention ring collar and cap, respectively.
Figure 5:
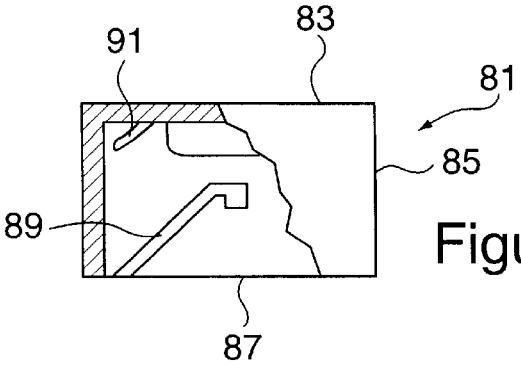

FIGS. 4 and 5 respectively show partial cut front views of alternate embodiment ring collars and caps. These two figures are discussed together. Thus, FIG. 4 shows ring collar 61 with open top 63, sidewall 65, ratchet wall 69 (with ratchets hidden) and open bottom 71. On the inside is cutout 73 which fits onto rib 7 of container 1 shown in FIG. 1. In this case, the ring collar is opposite that shown in FIG. 2 because it has on its outer wall keyway protrusion 67 instead of a keyway track.

The FIG. 5 cap 81 has a top 83, a sidewall 85 and an open bottom 87. There is a spring 91 which functions similarly to spring 51 of FIG. 3. On the inside wall of cap 81 is a keyway track 89 which has an inverted sloped J configuration and is adapted to fit onto protrusion 67 of ring collar 61 in FIG. 4.

FIGS. 6 through 13 show various components, views and positions of another present invention child resistant cap and dispenser. All of these figures should be taken together, with identical parts identically numbered.

Figure 6:
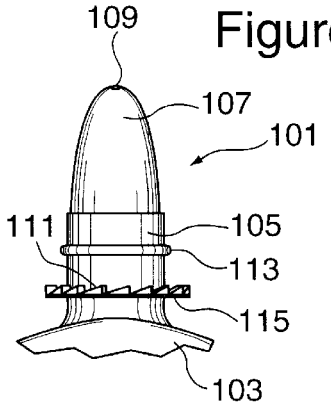
FIG. 6 shows another present invention container and ratchet flange.

FIG. 6 shows a squeeze bottle 101 with a main body 103, a neck 105 and an extended top 107 (origice reducer which is a separate molded part) with fine orifice 109 for dispensing fine mist or spray. Neck 105 has a flange 115 with one-way ratchets such as ratchet 111 and also has a collar rib attachment 113.

Figure 7:
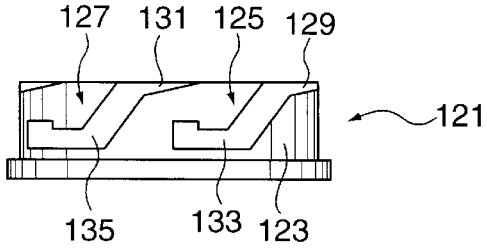
FIGS. 7 and 8 show an expanded flat view and an oblique side view of a present invention ring collar with multiple keyway tracks.
Figure 8:
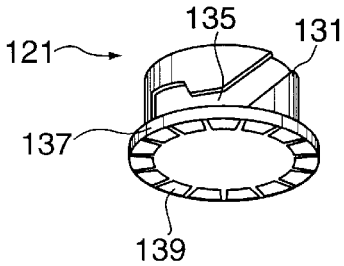

FIG. 7 shows a rolled outside view (flattened) of collar 121 shown in FIG. 8 in its true shape.

FIG. 7 is presented to merely illustrate features which are actually in the round and thus hidden in true depictions. The purpose of FIG. 7 is to illustrate the use of a plurality of keyways (in this regard, while only single keyways are shown above with respect to FIGS. 2 through 5, plural keyway tracks and plural keyway traps are preferred).

Referring to FIGS. 7 and 8, keyways 133 and 135 include guide ramps 129 and 131 on wall 123 to make cap connections easier thereby utilizing part of the keyway track sloped legs 125 and 127 as guide stops. In other words, when cap protrusions are rotated downwardly along tracks 129 and 131 they will contact the opposite top sides of the sloped legs of the keyways and thereby be guided down the keyways.

Figure 9:
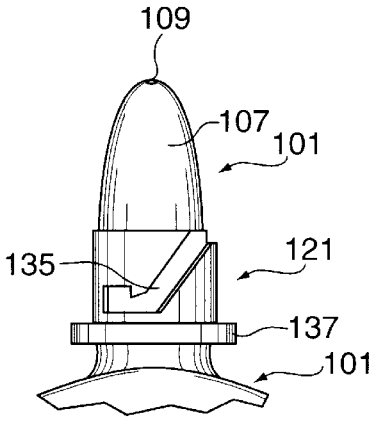
FIG. 9 shows a partial side view of the present invention container 6 assembled with the ring collar of FIG. 8; and, FIGS. 10 through 13 show partial side views of the FIG. 9 present invention device along with the present invention cap at various stages of closure.

One-way ratchets 139, located under flange 127, engage with one-way ratchets 111 of flange 115 of FIG. 6. On the inside of ring collar 121 is a cut out (not shown) which connects with rib 113. The assembled ring collar 121 with flange 115 and rib 113 of container 101 is shown in FIG. 9.

Figures 10, 11, 12, 13:
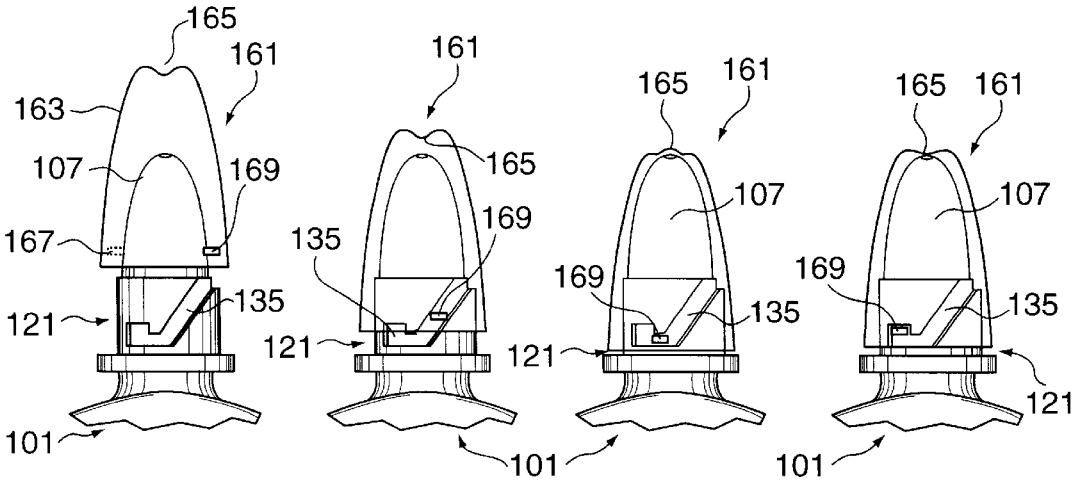

FIGS. 10 through 13 all show container 101 and ring collar 121, (with the flange concealed), and with cap 161. In this case, cap 161 is illustrated in a transparent form. It includes inside wall protrusions 167 and 169 for cooperation with keyway track 135 and its opposite keyway (not shown in FIGS. 10 through 13). The FIGS. 10 through 13 show cap 161 in various stages of uses, as follows:

In FIG. 10, cap 161 has an outside wall 163 and a flexible, downwardly biased top portion 165 which acts as a spring means. In FIG. 10, cap 161 is placed over top 107. In FIG. 11, protrusion 169 is moving downwardly clockwise along the sloped leg of keyway 135. In FIG. 12, protrusion 169 is in the horizontal leg of keyway track 135. At this point, downwardly biased top portion 165 is in a tension state and is pushing down on the top of extended top 107 to move cap 161 upwardly. As clockwise rotation continues, protrusion 169 moves into and pops up into the vertical leg of keyway track 135 as downwardly biassed top portion 165 forces it upward for secured locking.

Obviously, numerous modifications and variations of the present invention are possible in light of the above teachings. For example, while drawings herein illustrate ratchets close together completely around the peripheral of the collars and on the bottoms of the caps, either the caps or the collars could have fewer, spaced apart ratchets and the device would still function efficiently. It is therefore understood that within the scope of the appended claims, the invention may be practiced otherwise than as specifically described herein.

What is claimed is:

1. A child resistant cap and dispenser, which comprises:

(a) a dispensing container having a main body with walls and a bottom, and having a top with a neck and a dispensing orifice;

(b) a flange located about said container neck and having one-way ratchets with stops in one direction of rotation and ramps in an opposite direction, located thereon; said flange being non-rotatably connected to said container neck;

(c) a ring collar, non-removably and rotatably connected to said container neck and having one-way ratchets located thereon and in functional and cooperative contact with said flange ratchets so as to permit rotation of said ring collar about said container neck in one direction and so as to prevent rotation thereof about said container neck in an opposite direction, said ring collar having an outer circular wall, said wall having one of (i) at least one keyway track and, (ii) at least one keyway protrusion, located thereon, said keyway track having a non-linear path to create a locking position for said keyway protrusion requiring complex motion for unlocking;

(d) a cap adapted to fit onto said ring collar, said cap having the other of one of said (i) at least one keyway track and (ii) at least one keyway protrusion, located on an inside wall thereof;

(e) spring biasing means located on at least one of said neck, said collar and said cap, and located to bias said cap upwardly away from said dispensing container when said cap is connected to said ring collar;

wherein when said cap is placed onto said ring collar and rotated thereon in a downwardly rotating fashion, and said keyway track and said keyway protrusion engage to a locking position, said cap and ring collar may not be rotated in one direction due to ratchet stop interaction and said cap and ring collar may be rotated in an opposite direction while said keyway track and said keyway protrusion remain engaged in said locking position; and, wherein when said ring collar is held stationary and said cap is pressed downward and rotated in an unlocking keyway position, said cap may be removed from said ring collar.

2. The child resistant cap and dispenser of claim 1 wherein there are a plurality of keyway tracks and a plurality of keyway protrusions.

3. The child resistant cap and dispenser of claim 1 wherein said spring biasing means is a spring located on an inside area of said cap.

4. The child resistant cap and dispenser of claim 1 wherein said spring biasing means is a flexible top area of said cap which has a rest state biasing said cap away from said container and a tension state when said cap is pressed downwardly toward said container for unlocking said keyway track and keyway protrusion.

5. The child resistant cap and dispenser of claim 1 wherein said keyway track has a shape with U-turn contained therein.

6. The child resistant cap and dispenser of claim 5 wherein said keyway track has a sloped J configuration.

7. The child resistant cap and dispenser of claim 1 wherein said dispenser container is a squeeze bottle and said neck is a narrowing neck with a fine dispensing orifice at its top.

8. The child resistant cap and dispenser of claim 7 wherein said cap includes a sealing pixel which extends to seal said orifice when said cap is connected to said ring collar in a looking position.

9. The child resistant cap and dispenser of claim 1 wherein said at least one keyway track is located on the outside of said ring collar, and said at least one keyway protrusion is located on the inside of said cap.

10. The child resistant cap and dispenser of claim 9 wherein said keyway track has a sloped J configuration.

11. The child resistant cap and dispenser of claim 9 wherein there are a plurality of keyway tracks and a plurality of keyway protrusions.

12. The child resistant cap and dispenser of claim 9 wherein said spring biasing means is a flexible top area of said cap which has a rest state biasing said cap away from said container and a tension state when said cap is pressed downwardly toward said container for unlocking said keyway track and keyway protrusion.

13. The child resistant cap and dispenser of claim 9 wherein said spring biasing means is a spring located on an inside area of said cap.

14. The child resistant cap and dispenser of claim 13 wherein said keyway track has a shape with a U-turn contained therein.

15. The child resistant cap and dispenser of claim 9 wherein said keyway track has a shape with a U-turn contained therein.

16. The child resistant cap and dispenser of claim 15 wherein said dispenser container is a squeeze bottle and said neck is a narrowing neck with a fine dispensing orifice at its top.

17. The child resistant cap and dispenser of claim 15 wherein said cap includes a sealing pixel which extends to seal said orifice when said cap is connected to said ring collar in a locking position.

18. The child resistant cap and dispenser of claim 1 wherein said at least one keyway track is located on the inside of said cap and said at least one keyway protrusion is located on the outside of said ring collar outer wall.

19. The child resistant cap and dispenser of claim 18 wherein said keyway track has an inverted sloped J configuration.

20. The child resistant cap and dispenser of claim 18 wherein there are a plurality of keyway tracks and a plurality of keyway protrusions.

21. The child resistant cap and dispenser of claim 18 wherein said spring biasing means is a spring located on an inside area of said cap.

22. The child resistant cap and dispenser of claim 18 wherein said spring biasing means is a flexible top area of said cap which has a rest state biasing said cap away from said container and a tension state when said cap is pressed downwardly toward said container for unlocking said keyway track and keyway protrusion.

23. The child resistant cap and dispenser of claim 18 wherein said dispenser container is a squeeze bottle and said neck is a narrowing neck with a fine dispensing orifice at its top.

24. The child resistant cap and dispenser of claim 23 wherein said cap includes a sealing pixel which extends to seal said orifice when said cap is connected to said ring collar in a locking position.

* * * * *